US007997449B2

(12) United States Patent
Banco et al.

(10) Patent No.: US 7,997,449 B2
(45) Date of Patent: Aug. 16, 2011

(54) FLUID DELIVERY SYSTEM FOR DISPENSING PRIMARY AND SECONDARY FLUIDS

(75) Inventors: Michael J. Banco, Racine, WI (US); Douglas A. Soller, Racine, WI (US); Michael C. Fryan, Racine, WI (US); Steven A. Zach, Waterford, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 12/772,287

(22) Filed: May 3, 2010

(65) Prior Publication Data

US 2010/0206903 A1 Aug. 19, 2010

Related U.S. Application Data

(62) Division of application No. 11/768,109, filed on Jun. 25, 2007, now Pat. No. 7,775,401.

(51) Int. Cl.
*B67D 7/70* (2010.01)

(52) U.S. Cl. ..... 222/136; 239/308; 222/144.5; 222/145.7; 222/383.1; 222/631

(58) Field of Classification Search ..... 222/133, 222/136, 144.5, 383.1, 631, 145.1, 145.5, 222/145.7–145.8, 330–331; 239/304–308
See application file for complete search history.

(56) References Cited

U.S. PATENT DOCUMENTS

| | | | |
|---|---|---|---|
| 664,237 | A | 12/1900 | Deming |
| 1,059,611 | A | 4/1913 | Jordan |
| 1,071,432 | A | 8/1913 | Kelley |
| 1,517,496 | A | 12/1924 | Dee et al. |
| 1,948,401 | A | 2/1934 | Smith et al. |
| 2,200,875 | A | 5/1940 | Edwards et al. |
| 2,504,117 | A | 4/1950 | Downs |
| 2,513,081 | A | 6/1950 | Clark et al. |
| 3,269,389 | A | 8/1966 | Meurer et al. |

(Continued)

FOREIGN PATENT DOCUMENTS

| | | |
|---|---|---|
| CA | 1104531 | 7/1981 |

(Continued)

OTHER PUBLICATIONS

International Search Report and Written Opinion dated Sep. 17, 2008, Appl No. PCT/US2008/007633 (J-4224).

*Primary Examiner* — Frederick C Nicolas
*Assistant Examiner* — Andrew Bainbridge

(57) ABSTRACT

A trigger operated fluid delivery system for dispensing two different fluids is disclosed. The fluid delivery system includes a first container having a first primary fluid, a fluid inlet conduit in fluid communication with the first container, and a pump for drawing the first fluid through the fluid inlet conduit and into a pump chamber. A fluid discharge conduit is located downstream of the pump chamber. The fluid discharge conduit is in fluid communication with the pump chamber and a discharge orifice. The pump discharges the first fluid from the pump chamber into the fluid discharge conduit. The fluid delivery system also includes a second container having a second fluid, that delivers the second fluid into the fluid discharge conduit. The second fluid mixes with the first fluid when the first fluid is discharged into the fluid discharge conduit such that a mixture of the first fluid and the second fluid is discharged through the discharge orifice.

12 Claims, 9 Drawing Sheets

U.S. PATENT DOCUMENTS

| | | | | | |
|---|---|---|---|---|---|
| 3,303,970 | A | | 2/1967 | Breslau et al. | |
| 3,338,523 | A | * | 8/1967 | Tibbitt | 239/61 |
| 3,575,319 | A | | 4/1971 | Safianoff | |
| 3,592,385 | A | | 7/1971 | Smith | |
| 3,776,775 | A | | 12/1973 | Lazarus | |
| 3,786,963 | A | | 1/1974 | Metzler, III | |
| 3,966,089 | A | | 6/1976 | Klingaman | |
| 3,980,231 | A | | 9/1976 | Trondsen | |
| 4,335,837 | A | | 6/1982 | Bono | |
| 4,355,739 | A | | 10/1982 | Vierkotter | |
| 4,579,258 | A | | 4/1986 | Brown et al. | |
| 4,618,076 | A | | 10/1986 | Silvenis | |
| 4,747,523 | A | | 5/1988 | Dobbs | |
| 4,765,510 | A | | 8/1988 | Rende | |
| 4,773,562 | A | | 9/1988 | Gueret | |
| 4,826,048 | A | | 5/1989 | Skorka et al. | |
| 4,902,281 | A | | 2/1990 | Avoy | |
| 5,009,342 | A | | 4/1991 | Lawrence et al. | |
| 5,078,114 | A | | 1/1992 | Haag et al. | |
| 5,152,431 | A | | 10/1992 | Gardner et al. | |
| 5,152,461 | A | | 10/1992 | Proctor | |
| 5,169,029 | A | | 12/1992 | Behar et al. | |
| 5,332,157 | A | | 7/1994 | Proctor | |
| 5,339,990 | A | * | 8/1994 | Wilder | 222/135 |
| 5,370,275 | A | | 12/1994 | Mills et al. | |
| 5,385,270 | A | | 1/1995 | Cataneo et al. | |
| 5,398,846 | A | | 3/1995 | Corba et al. | |
| 5,402,916 | A | | 4/1995 | Nottingham et al. | |
| 5,433,350 | A | | 7/1995 | Graubart | |
| 5,439,141 | A | | 8/1995 | Clark et al. | |
| 5,472,119 | A | | 12/1995 | Park et al. | |
| 5,535,950 | A | | 7/1996 | Barriac et al. | |
| 5,560,545 | A | | 10/1996 | Grogan et al. | |
| 5,562,250 | A | | 10/1996 | O'Neill | |
| 5,626,259 | A | | 5/1997 | Maas et al. | |
| 5,634,571 | A | | 6/1997 | Cataneo et al. | |
| 5,683,014 | A | | 11/1997 | Smolen, Jr. et al. | |
| 5,711,457 | A | | 1/1998 | Wanbaugh et al. | |
| 5,752,626 | A | | 5/1998 | Bachand | |
| 5,769,275 | A | | 6/1998 | Boehmer et al. | |
| 5,819,987 | A | | 10/1998 | Miller | |
| 5,857,591 | A | | 1/1999 | Bachand | |
| 5,890,624 | A | | 4/1999 | Klima et al. | |
| 5,947,335 | A | | 9/1999 | Milio et al. | |
| 5,964,377 | A | * | 10/1999 | Demarest et al. | 222/136 |
| 5,996,847 | A | | 12/1999 | Smolen, Jr. et al. | |
| 6,006,957 | A | | 12/1999 | Kunesh | |
| 6,155,459 | A | | 12/2000 | Bunschoten et al. | |
| 6,308,863 | B1 | | 10/2001 | Harman | |
| 6,345,773 | B1 | | 2/2002 | Shanklin et al. | |
| 6,360,918 | B1 | | 3/2002 | Butler | |
| 6,431,402 | B1 | | 8/2002 | Klima et al. | |
| 6,550,694 | B1 | | 4/2003 | Foster et al. | |
| 6,551,001 | B2 | | 4/2003 | Aberegg et al. | |
| 6,640,999 | B2 | | 11/2003 | Peterson | |
| 6,659,311 | B2 | | 12/2003 | Prueter | |
| 6,685,107 | B1 | | 2/2004 | Salzman | |
| 6,729,560 | B2 | | 5/2004 | Foster et al. | |
| 2002/0190139 | A1 | | 12/2002 | Morrison | |
| 2002/0196701 | A1 | | 12/2002 | Mastbrook | |
| 2004/0238567 | A1 | | 12/2004 | Bloc | |
| 2004/0251274 | A1 | | 12/2004 | Ponton | |
| 2006/0079427 | A1 | | 4/2006 | Burt et al. | |

FOREIGN PATENT DOCUMENTS

| | | | |
|---|---|---|---|
| DE | 2115726 | | 10/1971 |
| EP | 0379627 | A1 | 8/1990 |
| WO | 90/01959 | A | 3/1990 |
| WO | 9617800 | A | 6/1996 |
| WO | 97/27947 | A | 8/1997 |

* cited by examiner

FLUID DELIVERY SYSTEM FOR DISPENSING PRIMARY AND SECONDARY FLUIDS

CROSS-REFERENCES TO RELATED APPLICATIONS

This application is a divisional application of U.S. patent application Ser. No. 11/768,109 filed Jun. 25, 2007.

STATEMENT REGARDING FEDERALLY SPONSORED RESEARCH

Not Applicable.

BACKGROUND OF THE INVENTION

1. Field of the Invention

This invention relates to a trigger operated fluid delivery system for dispensing two fluids. In particular, the invention relates to a trigger operated fluid dispenser that allows a user to add a secondary fluid to the spray of a primary fluid.

2. Description of the Related Art

It is often desirable to simultaneously dispense two types of fluid from two fluid containers of a trigger operated sprayer assembly. For example, when two fluids to be dispensed contain some active ingredients that are incompatible when these ingredients are mixed together in a single solution, it is desirable to contain the two fluids in separate compartments and then mix and dispense both fluids simultaneously as a single fluid. Also, it may be desirable to separately store a first liquid carrier and a second concentrate fluid and then mix and dispense both fluids simultaneously as a single fluid. The first primary fluid might be water or a dilute primary light-duty cleaner, and the secondary fluid may be a concentrate that when combined in small amounts with the primary fluid yields a new cleaning formulation. Alternatively, one container might hold a first fluid with an active ingredient, which the second fluid in the second container would activate. Non-limiting examples of such pairs of fluids could be a cleaning composition and a bleach, or a pair of stain removing compositions, one an aqueous composition and the other a high-solvent level enzyme containing composition. Whatever the pair of fluids, they are intended to be dispensed simultaneously and in a fixed ratio to each other, the ratio being set by the design of the trigger operated fluid delivery system itself.

There are many examples in the art of manually activated pumps for spraying two liquids simultaneously. For example, U.S. Pat. No. 5,560,545 describes a fluid dispenser that employs separate dip tubes drawing from separate bottle compartments with the two liquids to be dispensed being drawn by a single piston to a mixing chamber prior to spraying through a nozzle. U.S. Pat. No. 5,535,950 discloses a trigger actuated fluid dispenser for simultaneously dispensing two fluids separately stored in separate fluid compartments of a container wherein the dispenser includes side-by-side pump cylinders receiving side-by-side pump pistons reciprocable simultaneously during each pressure stroke applied by a single trigger lever for separately and simultaneously pumping the disparate fluids along separate discharge paths. The disclosures of these patents and of all other publications referred to herein are incorporated by reference as if fully set forth herein.

It has been recognized in the art that dispensers such as those in U.S. Pat. Nos. 5,560,545 and 5,535,950 do have disadvantages when attempting to deliver a concentrate from a secondary container. When the secondary container's contents are a concentrate, the dip tubes and other extensive fluid transfer means of dispensers such as those in U.S. Pat. Nos. 5,560,545 and 5,535,950 may require that inconvenient amounts of the concentrate be expended simply to prime the pump or otherwise fill the system. Furthermore, dispensers such as those in U.S. Pat. Nos. 5,560,545 and 5,535,950 do not provide for the convenient replacement of one secondary container by another secondary container, without disturbing the primary container.

The manually operable dispensing pump of U.S. Pat. No. 5,964,377 overcomes the aforementioned disadvantages of dispensers such as those in U.S. Pat. Nos. 5,560,545 and 5,535,950. U.S. Pat. No. 5,964,377 discloses a dispensing pump with a secondary fluid container that is attachable by secondary attachment means directly to the sprayer body at a location remote from the primary fluid container. The secondary container has an outlet that provides immediate communication between the secondary container and the sprayer mechanism so that contents of the secondary container can pass immediately into a mixing chamber in the sprayer body to be mixed with primary fluid pumped from the primary container. The secondary container is detachable and replaceable such that convenient recharging of the device with a refill secondary container or the exchange of one secondary container for another secondary container is possible.

It has also been recognized in the art that dispensers such as those in U.S. Pat. Nos. 5,560,545 and 5,535,950 do have problems with container venting and the proper maintenance of flow rates from the primary and secondary container. These problems have been addressed by the sprayer assembly of U.S. Pat. No. 5,819,987 which provides an apparatus for dispensing multiple fluids from nested containers, while simultaneously venting the fluid containers. The sprayer assembly includes a first container for containing a first fluid, a second container, nested within the first container, for containing a second fluid, and a manually operable pump for pumping fluid from the containers to dispense a mixture of the fluids from the apparatus. The pump includes a pump actuator, a reciprocating fluid conduit which reciprocates upon actuation and deactuation of the pump actuator, and a discharge nozzle for dispensing the mixture of the fluids from the apparatus upon actuation of the pump. The apparatus also includes a mixing chamber for mixing the first and second fluids drawn from the first and second containers, respectively, a fluid transfer conduit for withdrawing fluid from the first container into the mixing chamber and a fluid transfer mechanism for withdrawing fluid from the second container into the mixing chamber.

While the devices of U.S. Pat. Nos. 5,819,987 and 5,964,377 have solved various problems with manually activated pumps for spraying two liquids simultaneously, there is still a need for alternative fluid delivery systems for mixing and dispensing two separate fluids.

SUMMARY OF THE INVENTION

The foregoing needs can be met with a fluid delivery system according to the invention which allows a user to add a secondary fluid to the spray of a primary fluid. Commonly, the second fluid is a concentrate, active ingredient, or activating substance that is mixed in relatively small quantities with the first fluid, which may be a liquid diluent, carrier, or substance requiring activation just prior to use.

In one aspect, the invention provides a fluid delivery system for dispensing two fluids. The fluid delivery system includes a first container having a first primary fluid, a fluid inlet conduit in fluid communication with the first container, and a pump for drawing the first fluid through the fluid inlet conduit and into a pump chamber. The pump can be housed in a pump body. A fluid discharge conduit is located downstream of the pump chamber. The fluid discharge conduit is in fluid communication with the pump chamber and a discharge orifice. The pump discharges the first fluid from the pump chamber into the fluid discharge conduit. The fluid delivery system also includes a second container having a second fluid, and means for delivering the second fluid into the fluid discharge conduit. In the fluid delivery system, the second fluid mixes with the first fluid when the first fluid is discharged into the fluid discharge conduit such that a mixture of the first fluid and the second fluid is discharged through the discharge orifice.

In one version of the invention, the means for delivering the second fluid into the fluid discharge conduit includes an aperture in fluid communication with the fluid discharge conduit and a mouth of the second container. The means for delivering the second fluid into the fluid discharge conduit can further include a flow restrictor for selectively sealing off the mouth of the second container. In another version of the invention, the means for delivering the second fluid into the fluid discharge conduit includes a wicking device in fluid communication with the fluid discharge conduit and a mouth of the second container. In yet another version of the invention, the means for delivering the second fluid into the fluid discharge conduit comprises a second pump for pumping the second fluid into the fluid discharge conduit. The second pump can include an air space in the pump body and an elastic wall section of the pump body wherein the elastic wall section is located adjacent the air space such that flexing of the elastic wall section forces air into the second container to pump the second fluid into the fluid discharge conduit.

The fluid delivery system can include a second fluid discharge conduit downstream of the pump chamber wherein the second fluid discharge conduit is in fluid communication with the pump chamber and the discharge orifice. A flow selector can be located between the pump chamber and the fluid discharge conduit and located between the pump chamber and the second fluid discharge conduit. The flow selector can have a first position in which the first fluid is delivered from the pump chamber into the fluid discharge conduit and can have a second position in which the first fluid is delivered from the pump chamber into the second fluid discharge conduit. Optionally, the second fluid discharge conduit is in fluid communication with the pump chamber and a second discharge orifice.

In the fluid delivery system, a distal end of the fluid discharge conduit can include a nozzle manifold in fluid communication with the discharge orifice, and the second fluid can be delivered into the nozzle manifold. The second container can be mounted on a side of the pump body opposite the first container, and the second container can be mounted in a well in a side of the pump body.

In another aspect, the invention provides a fluid delivery system for dispensing two fluids. The fluid delivery system includes a first container having a first primary fluid, a fluid inlet conduit in fluid communication with the first container, and a pump for drawing the first fluid through the fluid inlet conduit and into a pump chamber. The pump can be housed in a pump body. A fluid discharge conduit can be located downstream of the pump chamber, and the fluid discharge conduit is placed in fluid communication with the pump chamber and a discharge orifice. The pump discharges the first fluid from the pump chamber into the fluid discharge conduit and through the discharge orifice.

The fluid delivery system includes a second container having a second fluid, and the second container can be mounted on the pump body. A second fluid discharge conduit can be placed in fluid communication with the second container and a second discharge orifice. The fluid delivery system also includes fluid delivery means for moving the second fluid from the second container through the second fluid discharge conduit and through the second discharge orifice. The fluid delivery means can include a propellant in the second container and a valve in the second fluid discharge conduit. The valve has an open position for delivering the second fluid from the second container to the second fluid discharge conduit. The fluid delivery means can further include an actuator for moving the valve into the open position. In one version of the invention, the second container is mounted on a side of the pump body opposite the first container. In another version of the invention, the second container is mounted in a well in a side of the pump body.

In yet another aspect, the invention provides a fluid delivery system for dispensing two fluids. The fluid delivery system includes a first container having a first fluid, a fluid inlet conduit in fluid communication with the first container, and a first fluid discharge conduit in fluid communication with the fluid inlet conduit and a discharge orifice. The fluid delivery system also includes a second fluid discharge conduit in fluid communication with the fluid inlet conduit, a second container having a second fluid, and means for delivering the second fluid into the first fluid discharge conduit. The fluid delivery system can also include means for pumping the first fluid from the first container through the fluid inlet conduit and into the first fluid discharge conduit and into the second fluid discharge conduit. In the fluid delivery system, the second fluid mixes with the first fluid when the first fluid is pumped into the first fluid discharge conduit such that a mixture of the first fluid and the second fluid can be discharged through the discharge orifice. In one version of the invention, a flow selector is located between the fluid inlet conduit and the first fluid discharge conduit and located between the fluid inlet conduit and the second fluid discharge conduit. The flow selector can have a first position in which the first fluid is delivered from the fluid inlet conduit into the first fluid discharge conduit and can have a second position in which the first fluid is delivered from the fluid inlet conduit into the second fluid discharge conduit.

These and other features, aspects, and advantages of the present invention will become better understood upon consideration of the following detailed description, drawings, and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
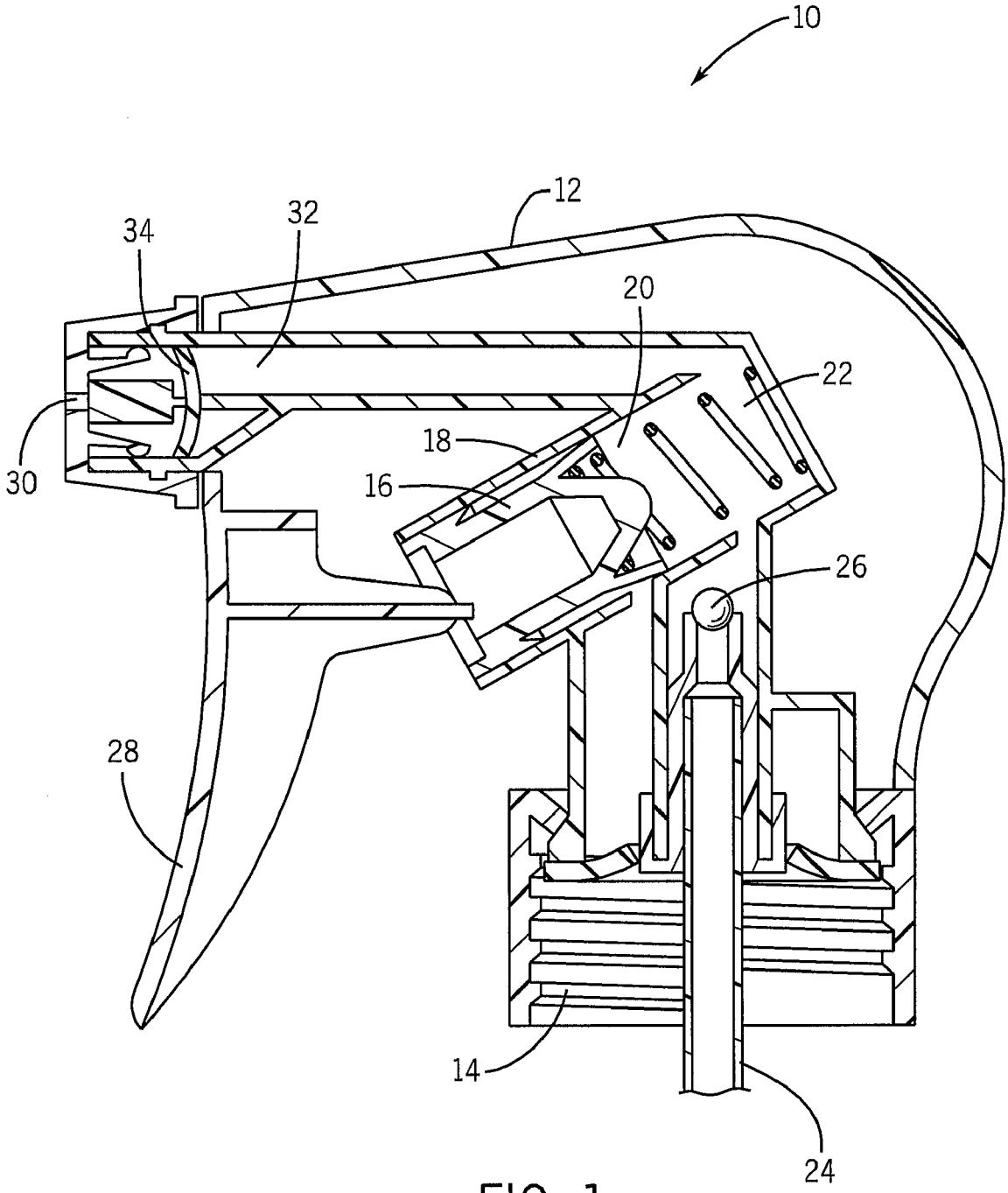
FIG. 1 PRIOR ART
FIG. 1 is a cross-sectional view of a prior art dispenser for delivering a single fluid from a container.

In order to provide background context for the present invention, FIG. 1 shows a prior art dispenser for delivering a single fluid from a container. The dispenser 10 has a body 12 that has attachment means to attach the body 12 to a container (not shown) such as the threads 14. The dispenser 10 includes a sprayer mechanism held by or formed within the body 12. The sprayer mechanism includes a piston 16 and cylinder 18 having cylinder head space 20 above the face of the piston 16. A cylindrical chamber 22 is provided that is in fluid communication with the cylinder head space 20. The dispenser 10 also includes a cylindrical dip tube 24 for transferring fluid to the chamber 22 from the container. The fluid transfer means includes a ball check valve 26 which allows fluid being transferred via the fluid transfer means to flow only toward and not away from the chamber 22.

The dispenser 10 also includes a finger operated trigger 28 for reciprocatingly moving the piston 16 within the cylinder 18, alternatingly increasing and decreasing the cylinder head space 20 to draw liquid into the chamber 22 and then expel liquid from the chamber 22. The dispenser 10 also includes a circular discharge orifice 30, together with a cylindrical discharge conduit 32 that provides fluid communication between the chamber 22 and the discharge orifice 30. The discharge conduit 32 has a discharge check valve 34 that permits fluid to move toward the discharge orifice 30 and not back toward the chamber 22.

Figure 2:
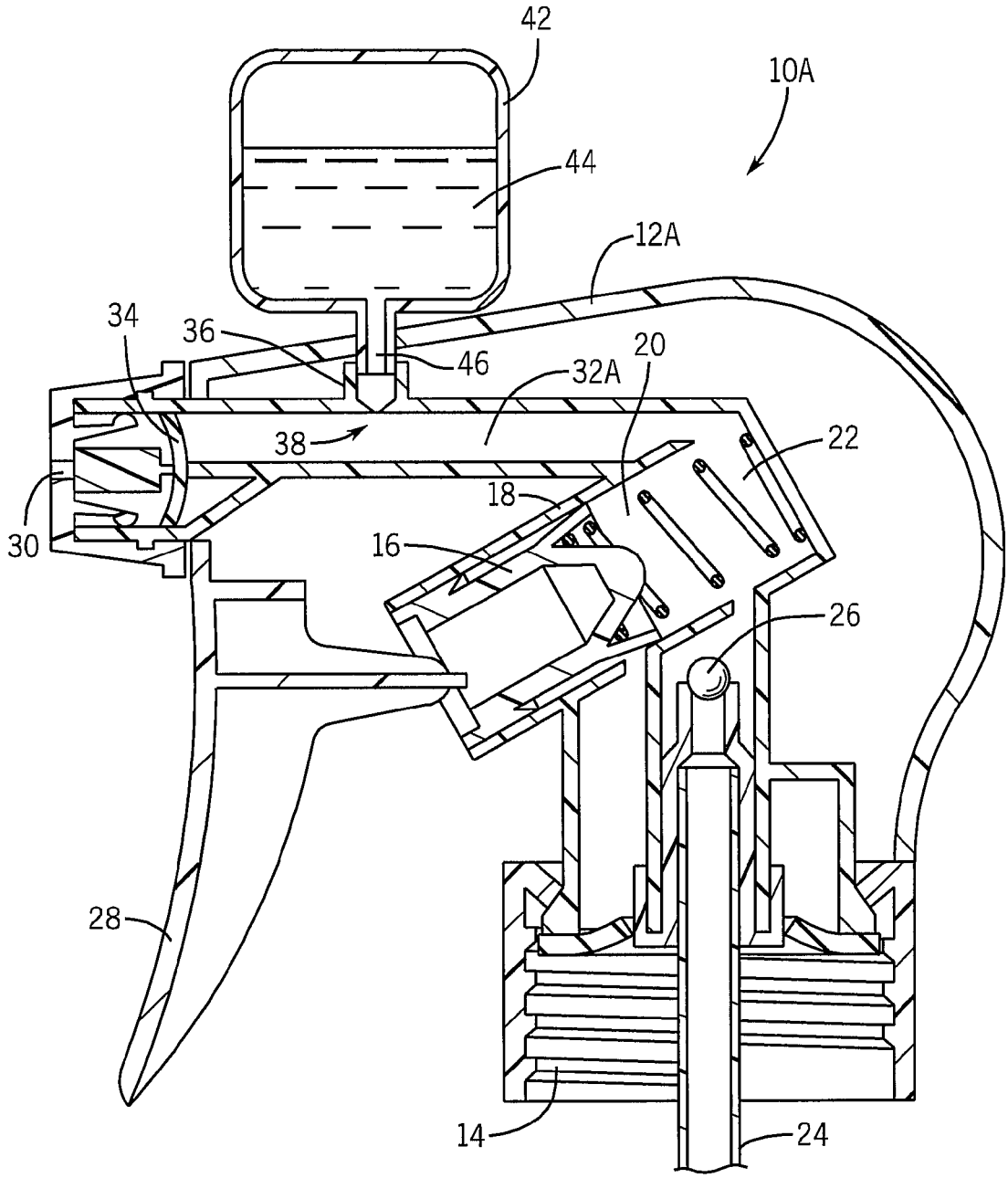
FIG. 2 is a cross-sectional view of an embodiment of a trigger operated fluid delivery system according to the invention for dispensing two fluids.

Turning now to FIG. 2, there is shown an example embodiment of a trigger operated fluid delivery system 10A according to the invention. The fluid delivery system 10A includes attachment means (threads 14), piston 16, cylinder 18, cylinder head space 20, chamber 22, dip tube 24, check valve 26, trigger 28, discharge orifice 30 and discharge check valve 34 that operate as described above with respect to the fluid dispenser 10 of FIG. 1. However, the fluid delivery system 10A includes a body 12A having an alternative cylindrical discharge conduit 32A that transfers fluid from the chamber 22 through the check valve 34 and to the discharge orifice 30.

The discharge conduit 32A of the fluid delivery system 10A includes a cylindrical inlet port 36 having a bottom exit aperture 38 that provides fluid communication between the inlet port 36 and the discharge conduit 32A. The fluid delivery system 10A also includes an inverted secondary container 42 having a secondary fluid 44. The secondary container 42 has a cylindrical mouth 46 through which the secondary fluid 44 may flow when exiting the secondary container 42. The mouth 46 is secured in the cylindrical inlet port 36 as shown in FIG. 2. The mouth 46 may be secured in the cylindrical inlet port 36 by suitable means such as an interference fit, threads, a bayonet connection, or a twist lock connection.

In operation of the fluid delivery system 10A, the finger operated trigger 28 reciprocatingly moves the piston 16 within the cylinder 18, alternatingly increasing and decreasing the cylinder head space 20 to draw a primary fluid into the chamber 22 and then expel the primary fluid from the chamber 22. The primary fluid flows from chamber 22 into the discharge conduit 32A toward the discharge orifice 30. As the primary fluid moves past the bottom exit aperture 38 in the inlet port 36, the primary fluid draws the secondary fluid 44 through the bottom exit aperture 38 and into the discharge conduit 32A where the secondary fluid 44 mixes with the stream of primary fluid. The primary fluid/secondary fluid mixture then flows past the check valve 34 and out of the discharge orifice 30. The viscosity of the secondary fluid 44, the size of the bottom exit aperture 38, the size of the inlet port 36 and the size of the mouth 46 of the secondary container 42 can be varied to control the amount of the secondary fluid 44 delivered into the primary fluid in the discharge conduit 32A.

Figure 3:
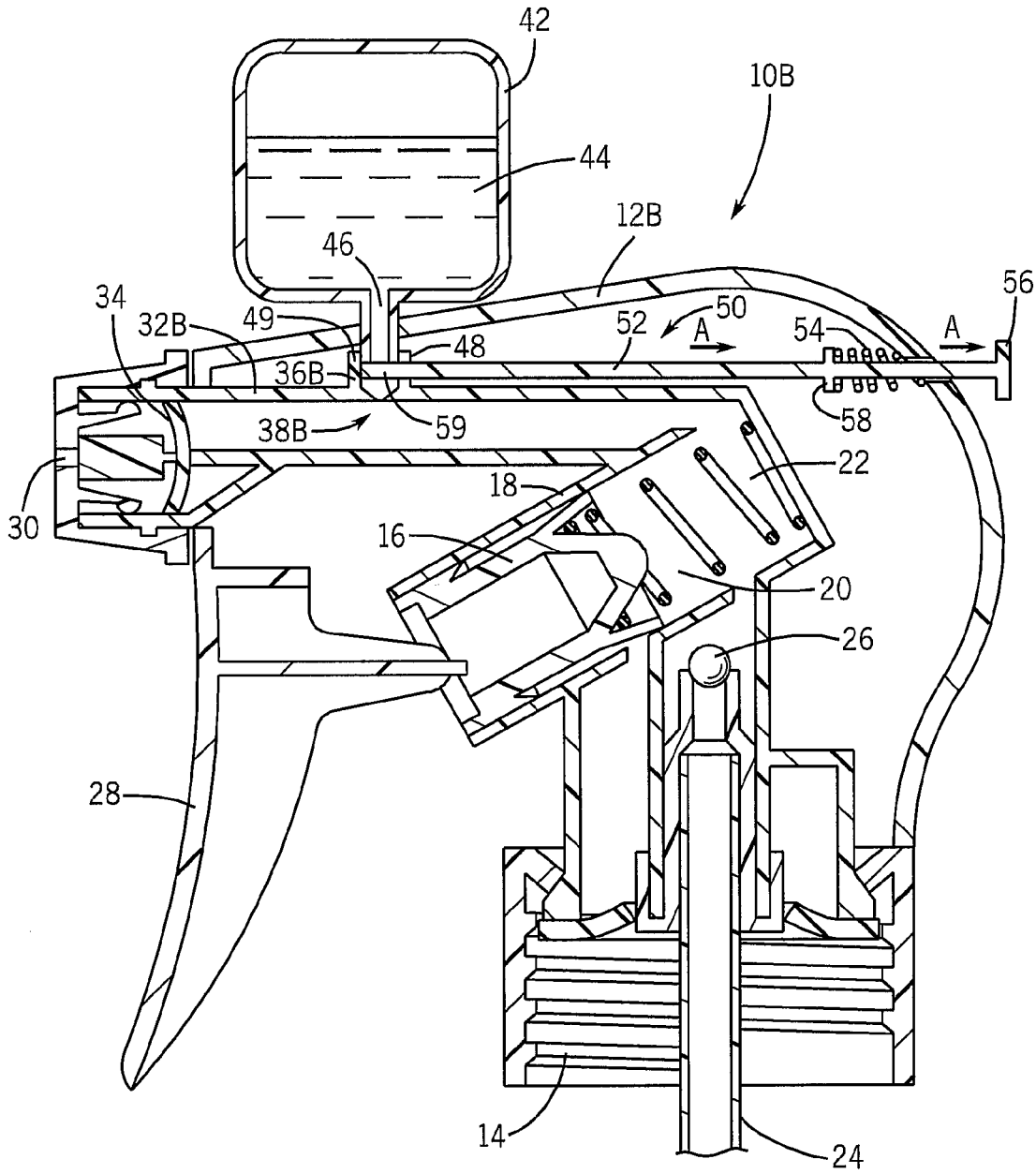
FIG. 3 is a cross-sectional view of another embodiment of a trigger operated fluid delivery system according to the invention for dispensing two fluids.

Referring now to FIG. 3, there is shown another example embodiment of a trigger operated fluid delivery system 10B according to the invention. The fluid delivery system 10B includes attachment means (threads 14), piston 16, cylinder 18, cylinder head space 20, chamber 22, dip tube 24, check valve 26, trigger 28, discharge orifice 30 and discharge check valve 34 that operate as described above with respect to the fluid dispenser 10 of FIG. 1. However, the fluid delivery system 10B includes a body 12B having an alternative cylindrical discharge conduit 32B that transfers fluid from the chamber 22 through the check valve 34 and to the discharge orifice 30.

The discharge conduit 32B of the fluid delivery system 10B includes a cylindrical inlet port 36B having a bottom exit aperture 38B that provides fluid communication between the inlet port 36B and the discharge conduit 32B. The inlet port 36B has a circular hole 48 in its side wall. The fluid delivery system 10B also includes inverted secondary container 42 having secondary fluid 44. The secondary container 42 has mouth 46 through which the secondary fluid 44 may flow when exiting the secondary container 42. The mouth 46 is secured in the cylindrical inlet port 36B as shown in FIG. 3. The mouth 46 may be secured in the cylindrical inlet port 36B by suitable means such as an interference fit, threads, a bayonet connection, or a twist lock connection.

The fluid delivery system 10B also includes a flow restrictor 50 including an elongated cylindrical shaft 52, a helical compression spring 54, a circular grip 56, and a circular stop 58. The distal end 59 of the shaft 52 of the flow restrictor 50 extends through the hole 48 in the side wall of the inlet port 36B. The spring 54 is located between the stop 58 and an inner wall of the body 12B. As a result, the spring 54 biases the distal end 59 of the shaft 52 of the flow restrictor 50 against the side wall 49 of the inlet port 36B, and the distal end 59 of the shaft 52 closes off the mouth 46 of the secondary container 42. However, when a user pulls the grip 56 in direction A, the shaft 52 moves in direction A and the bottom of the mouth 46 of the secondary container 42 is opened allowing the secondary fluid 44 to flow into the inlet port 36B.

In operation of the fluid delivery system 10B, the finger operated trigger 28 reciprocatingly moves the piston 16 within the cylinder 18, alternatingly increasing and decreasing the cylinder head space 20 to draw a primary fluid into the chamber 22 and then expel the primary fluid from the chamber 22. The primary fluid flows from chamber 22 into the discharge conduit 32B toward the discharge orifice 30. As the primary fluid moves past the bottom exit aperture 38B in the inlet port 36B, the primary fluid draws the secondary fluid 44 in the inlet port 36B through the bottom exit aperture 38B and into the discharge conduit 32B where the secondary fluid 44 mixes with the stream of primary fluid. The primary fluid/secondary fluid mixture then flows past the check valve 34 and out of the discharge orifice 30.

In the fluid delivery system 10B, the delivery of the secondary fluid 44 into the discharge conduit 32B is controlled by the flow restrictor 50. When introduction of the secondary fluid 44 into the primary fluid is desired, the grip 56 is pulled in direction A so that the secondary fluid 44 can be introduced into the inlet port 36B and then delivered into the primary fluid in the discharge conduit 32A when the primary fluid flows through the discharge conduit 32B. When introduction of the secondary fluid 44 into the primary fluid is not desired, the grip 56 is not pulled. In this manner, the secondary fluid 44 can be used only when specifically desired by the user.

In the fluid delivery system 10B, mixing of the secondary fluid 44 into the primary fluid can be achieved using different fluid transport methods. For example, the primary fluid may draw the secondary fluid 44 in the inlet port 36B through the bottom exit aperture 38B using a siphon feed or venturi effect. Alternatively, for certain secondary fluids, the flow restrictor 50 may allow for gravity feed of the secondary fluid 44 through the bottom exit aperture 38B into the discharge conduit 32B.

Figure 4:
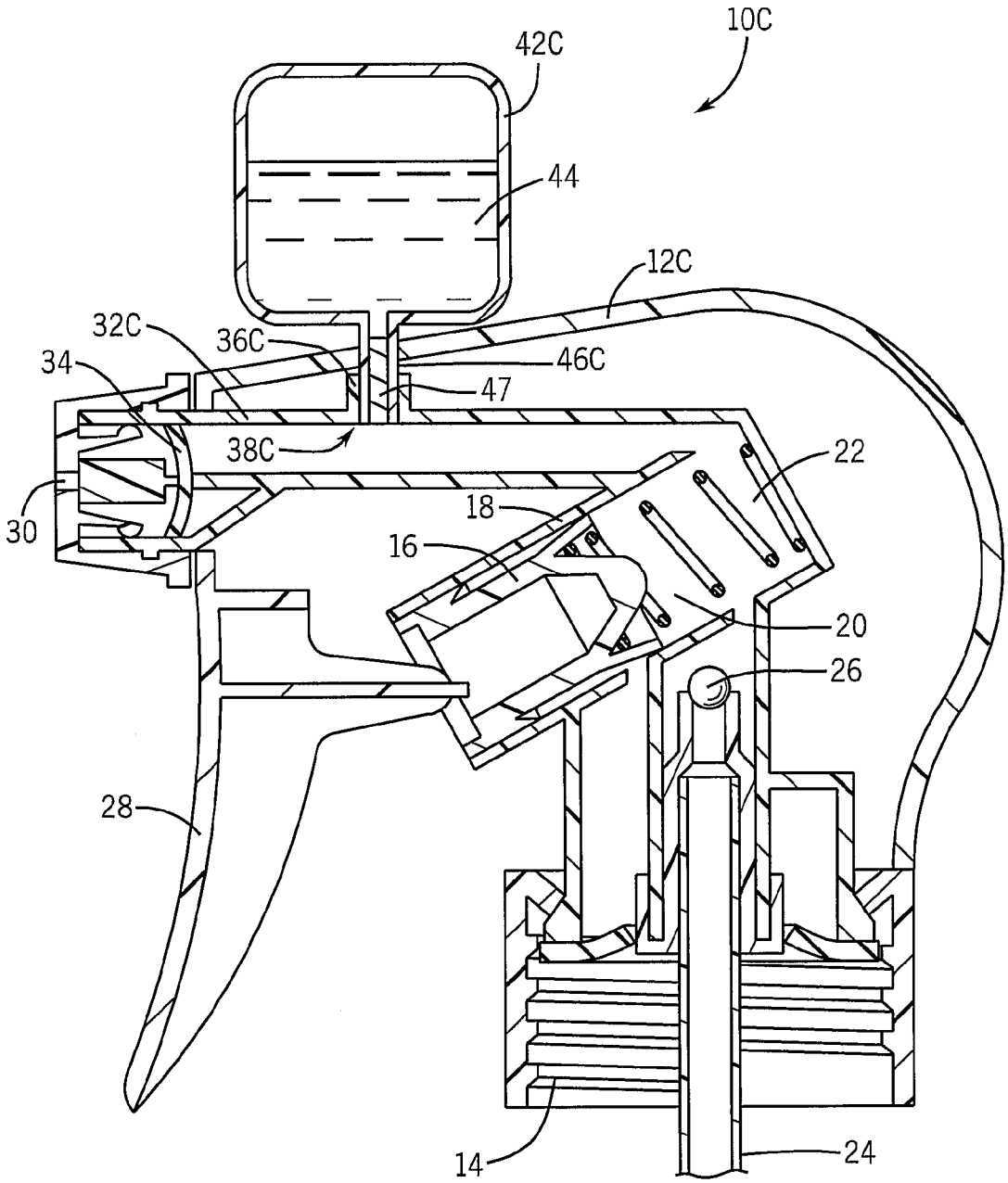
FIG. 4 is a cross-sectional view of yet another embodiment of a trigger operated fluid delivery system according to the invention for dispensing two fluids.

Turning now to FIG. 4, there is shown a yet another example embodiment of a trigger operated fluid delivery system 10C according to the invention. The fluid delivery system 10C includes attachment means (threads 14), piston 16, cylinder 18, cylinder head space 20, chamber 22, dip tube 24, check valve 26, trigger 28, discharge orifice 30 and discharge check valve 34 that operate as described above with respect to the fluid dispenser 10 of FIG. 1. However, the fluid delivery system 10C includes a body 12C having an alternative cylindrical discharge conduit 32C that transfers fluid from the chamber 22 through the check valve 34 and to the discharge orifice 30.

The discharge conduit 32C of the fluid delivery system 10C includes a cylindrical inlet port 36C having a bottom exit aperture 38C that provides fluid communication between the inlet port 36C and the discharge conduit 32C. The fluid delivery system 10C also includes an inverted secondary container 42C having a secondary fluid 44. The secondary container 42 has a cylindrical mouth 46C through which the secondary fluid 44 may flow when exiting the secondary container 42C. The mouth 46C is secured in the cylindrical inlet port 36C as shown in FIG. 4. The mouth 46C may be secured in the cylindrical inlet port 36C by suitable means such as an interference fit, threads, a bayonet connection, or a twist lock connection. In the mouth 46C of the secondary container 42C, there is placed a wick 47 that delivers secondary fluid 44 from the secondary container 42C by capillary action to the bottom exit aperture 38C of the cylindrical inlet port 36C.

In operation of the fluid delivery system 10C, the finger operated trigger 28 reciprocatingly moves the piston 16 within the cylinder 18, alternatingly increasing and decreasing the cylinder head space 20 to draw a primary fluid into the chamber 22 and then expel the primary fluid from the chamber 22. The primary fluid flows from chamber 22 into the discharge conduit 32C toward the discharge orifice 30. As the primary fluid moves over the wick 47, the primary fluid draws the secondary fluid 44 into the discharge conduit 32C where the secondary fluid 44 mixes with the stream of primary fluid. The primary fluid/secondary fluid mixture then flows past the check valve 34 and out of the discharge orifice 30. The viscosity of the secondary fluid 44, the size of the bottom exit aperture 38C, the size of the inlet port 36C, the wick material, and the size of the mouth 46C of the secondary container 42C can be varied to control the amount of the secondary fluid 44 delivered into the primary fluid in the discharge conduit 32C. Suitable wick materials include: porous or sintered plastics such as ultra high molecular weight polyethylene and polypropylene; bonded fibers such as polyesters and polypropylene; glass-sintered fibers; porous ceramic; carbon fiber; sintered carbon; wood and compressed wood composites; bundled or woven natural fibers such as cotton, wood, linen; and bundled or woven man made fibers such as nylon, polypropylene, polyethylene, polyesters, polyamides, rayon, and polyacetates, or the like.

Figure 5:
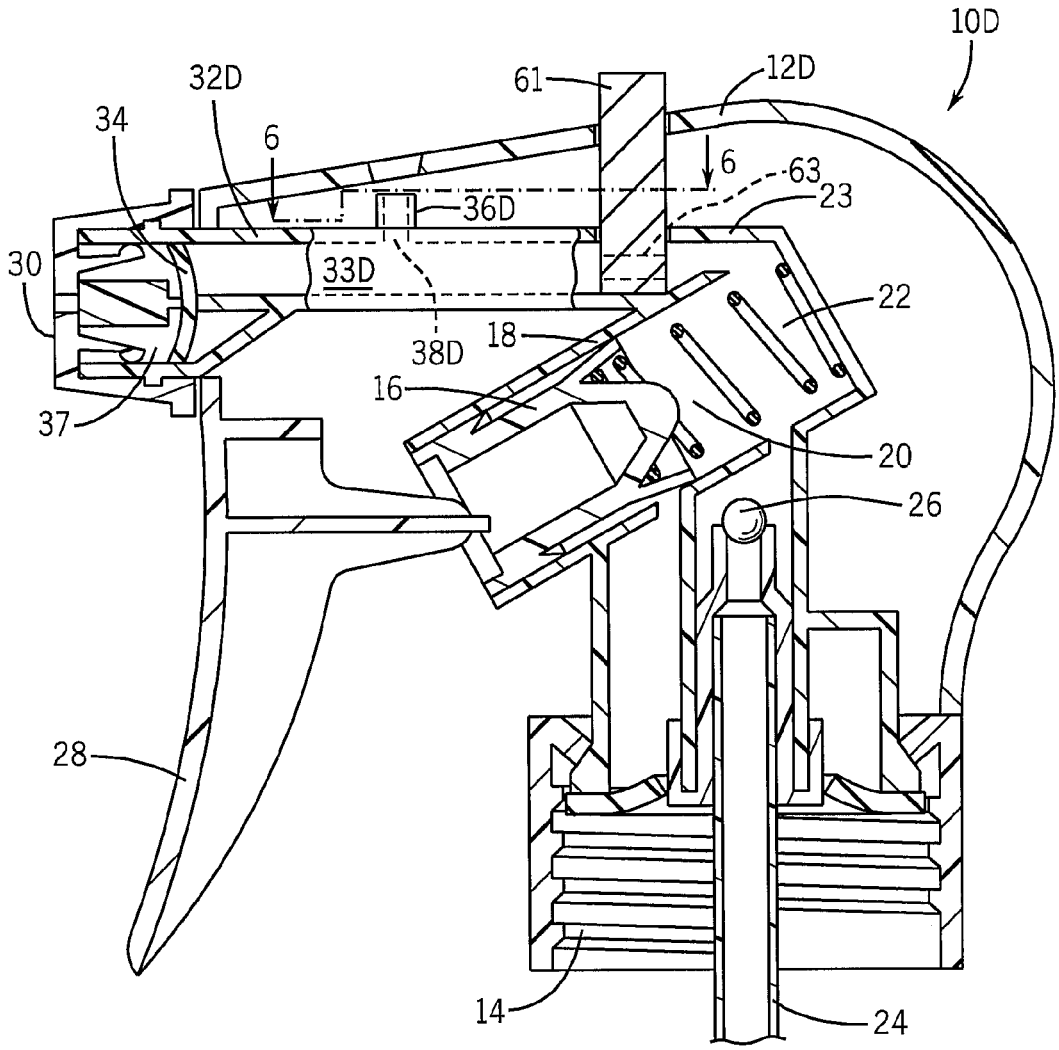
FIG. 5 is a cross-sectional view of still another embodiment of a trigger operated fluid delivery system according to the invention for dispensing two fluids.
Figure 6:
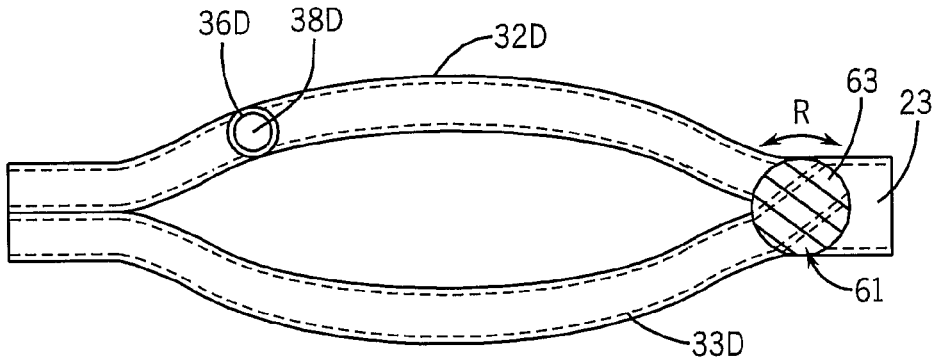
FIG. 6 is a partial view of the multiple path discharge conduit system of the fluid delivery system of FIG. 5 taken along line 6-6 of FIG. 5.

Referring now to FIGS. 5 and 6, there is shown an example embodiment of a trigger operated fluid delivery system 10D according to the invention. The fluid delivery system 10D includes attachment means (threads 14), piston 16, cylinder 18, cylinder head space 20, chamber 22, dip tube 24, check valve 26, trigger 28, discharge orifice 30 and discharge check valve 34 that operate as described above with respect to the fluid dispenser 10 of FIG. 1. However, the fluid delivery system 10D includes a body 12D having a first tubular discharge conduit 32D and a second tubular discharge conduit 33D (see FIG. 6) that transfer fluid from the chamber 22 through the check valve 34 and to the discharge orifice 30.

The first tubular discharge conduit 32D of the fluid delivery system 10D includes a cylindrical inlet port 36D having a bottom exit aperture 38D that provides fluid communication between the inlet port 36D and the discharge conduit 32D. The fluid delivery system 10D also includes an inverted secondary container (not shown) having a secondary fluid and a cylindrical mouth through which the secondary fluid may flow when exiting the secondary container. The secondary container, the secondary fluid, and the secondary container mouth of the fluid delivery system 10D can be the same as the secondary container 42, the secondary fluid 44, and the secondary container mouth 46 of the fluid delivery system 10A of FIG. 2. In the fluid delivery system 10D, the mouth may be secured in the cylindrical inlet port 36D by suitable means such as an interference fit, threads, a bayonet connection, or a twist lock connection.

The second tubular discharge conduit 33D is located adjacent the tubular discharge conduit 32D. At the upstream end of the first tubular discharge conduit 32D and the second tubular discharge conduit 33D, there is located a flow selector 61. The flow selector 61 has a throughhole 63, and can be rotated in directions R as shown in FIG. 6. The flow selector 61 has a first position (see FIG. 6) in which the throughhole 63 is aligned with the second tubular discharge conduit 33D and an upstream discharge conduit 23 that is in fluid communication with the pump chamber 22. The flow selector 61 also has a second position in which the throughhole 63 is aligned with the first tubular discharge conduit 32D and the upstream discharge conduit 23.

In operation of the fluid delivery system 10D, the finger operated trigger 28 reciprocatingly moves the piston 16 within the cylinder 18, alternatingly increasing and decreasing the cylinder head space 20 to draw a primary fluid into the chamber 22 and then expel the primary fluid from the chamber 22. The primary fluid flows from chamber 22 into the upstream discharge conduit 23.

When the flow selector 61 is the first position, primary fluid flows from the upstream discharge conduit 23, through the throughhole 63, and into the second tubular discharge conduit 33D toward the discharge orifice 30. The primary fluid then flows past the check valve 34 and out of the discharge orifice 30.

When the flow selector 61 is the second position, primary fluid flows from the upstream discharge conduit 23, through the throughhole 63, and into the tubular discharge conduit 32D toward the discharge orifice 30. As the primary fluid moves past the bottom exit aperture 38D in the inlet port 36D, the primary fluid draws the secondary fluid through the bottom exit aperture 38D and into the discharge conduit 32D where the secondary fluid mixes with the stream of primary fluid. The primary fluid/secondary fluid mixture then flows past the check valve 34 and out of the discharge orifice 30. The viscosity of the secondary fluid, the size of the bottom exit aperture 38D, the size of the inlet port 36D and the size of the mouth of the secondary container can be varied to control the amount of the secondary fluid delivered into the primary fluid in the first discharge conduit 32D.

The fluid delivery system 10D provides a user with a number of fluid delivery options. When a user just wishes to dispense a primary fluid, the flow selector 61 is placed in the first position, and the primary fluid is dispensed from the discharge orifice 30. When a user wishes to dispense a primary fluid/secondary fluid mixture, then the flow selector 61 is placed in the second position such that a primary fluid/secondary fluid mixture flows past the check valve 34 and out of the discharge orifice 30. Optionally, the flow selector 61 may include an off position in which flow is blocked from the upstream discharge conduit 23.

In the fluid delivery system 10D of FIGS. 5 and 6, the first tubular discharge conduit 32D and the second tubular discharge conduit 33D both discharge into a nozzle manifold 37 before fluid exits the discharge orifice 30. However, the first discharge conduit 32D and the second tubular discharge conduit 33D can have separate discharge orifices in order to prevent any introduction of the secondary fluid into the nozzle manifold 37.

Figure 7:
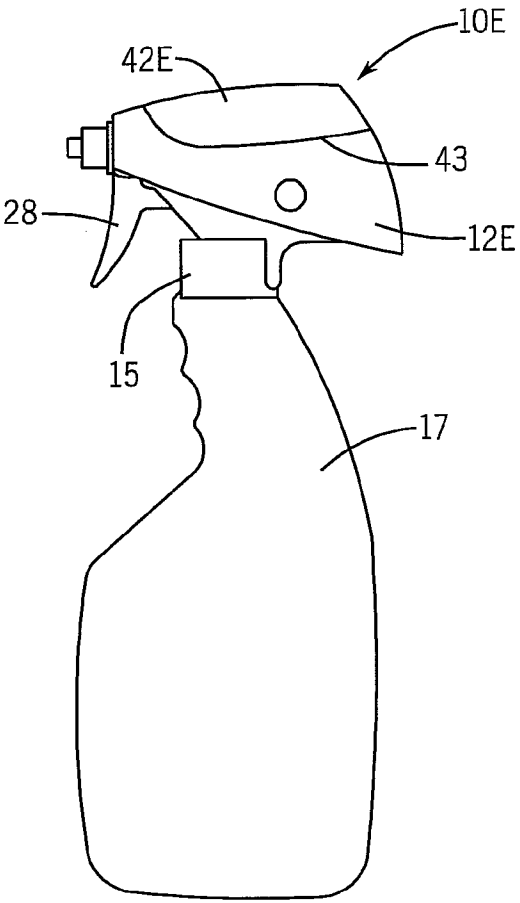
FIG. 7 is a front view of yet another embodiment of a trigger operated fluid delivery system according to the invention mounted on a fluid container.

Turning now to FIG. 7, there is shown an example embodiment of a trigger operated fluid delivery system 10E according to the invention. The fluid delivery system 10E includes attachment means (cap 15), a container 17, a piston, a cylinder, a cylinder head space, a pump chamber, a dip tube, a check valve, a trigger, a discharge orifice and a discharge check valve that operate in the same manner as described above with respect to the fluid dispenser 10 of FIG. 1. However, the fluid delivery system 10E includes a body 12E having an alternative cylindrical discharge conduit that transfers fluid from the chamber through the check valve and to the discharge orifice. The discharge conduit of the fluid delivery system 10E includes a cylindrical inlet port having a bottom exit aperture that provides fluid communication between the inlet port and the discharge conduit as in the fluid delivery system 10A of FIG. 2. However, compared to the fluid delivery system 10A of FIG. 2, the fluid delivery system 10E includes a tubular secondary container 42E having a secondary fluid. The secondary container 42E has a cylindrical mouth through which the secondary fluid may flow when exiting the secondary container 42E. The mouth is secured in the cylindrical inlet port in a similar manner as shown in FIG. 2. The mouth may be secured in the cylindrical inlet port by suitable means such as an interference fit. The secondary container 42E of the fluid delivery system 10E has a horizontally extending orientation as the secondary container 42E seats in a well 43 of the body 12E.

In operation of the fluid delivery system 10E, the finger operated trigger 28 reciprocatingly moves the piston within the cylinder, alternatingly increasing and decreasing the cylinder head space to draw a primary fluid into the chamber and then expel the primary fluid from the chamber. The primary fluid flows from chamber into the discharge conduit toward the discharge orifice. As the primary fluid moves past the bottom exit aperture in the inlet port, the primary fluid draws the secondary fluid from the secondary container 42E through the bottom exit aperture and into the discharge conduit where the secondary fluid mixes with the stream of primary fluid. The primary fluid/secondary fluid mixture then flows past the check valve and out of the discharge orifice.

Figure 8:
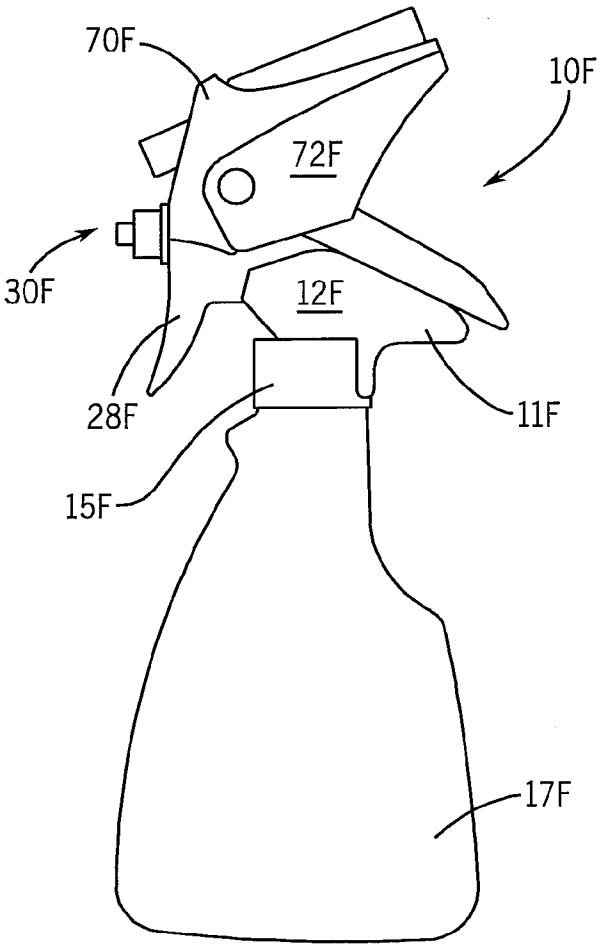
FIG. 8 is a front view of still another embodiment of a trigger operated fluid delivery system according to the invention mounted on a fluid container.
Figure 9:
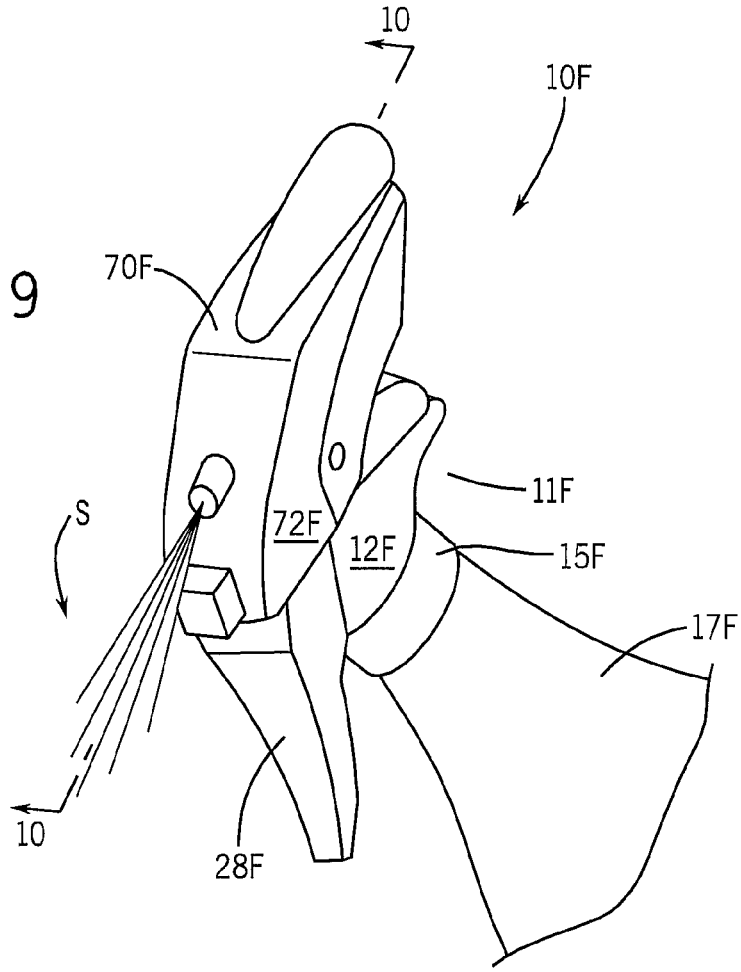
FIG. 9 is a detailed partial perspective view of the fluid delivery system and container of FIG. 8.
Figure 10:
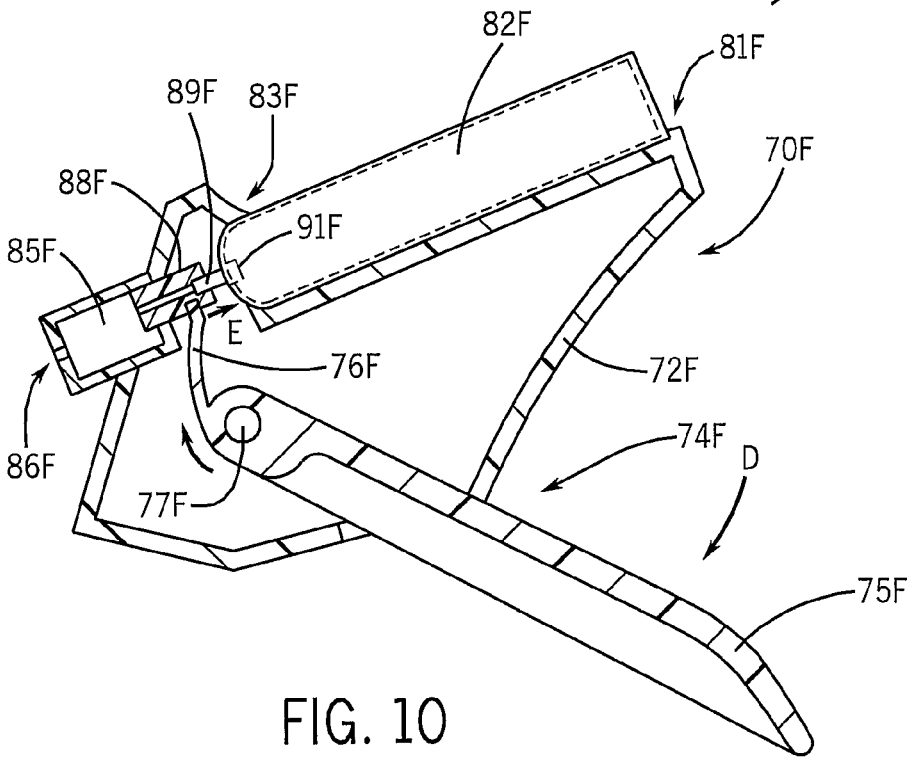
FIG. 10 is a cross-sectional view of the fluid delivery structure for the second container of the fluid delivery system of FIG. 8.

Referring now to FIGS. 8-10, there is shown another example embodiment of a trigger operated fluid delivery system 10F according to the invention. The fluid delivery system 10F includes a fluid dispenser 11F that operates in the same manner as the fluid dispenser 10 of FIG. 1. Specifically, the fluid dispenser 11F has a body 12F that has attachment means (cap 15F) to attach the body 12F to a container 17F using, for example, threads. The fluid dispenser 11F includes a sprayer mechanism held by or formed within the body 12F. The sprayer mechanism includes a piston (similar to 16 in FIG. 1) and a pump cylinder (similar to 18 in FIG. 1) having cylinder head space (similar to 20 in FIG. 1) above the face of the piston. A cylindrical chamber (similar to 22 in FIG. 1) is provided that is in fluid communication with the cylinder head space. The fluid dispenser 11F also includes a cylindrical dip tube (similar to 24 in FIG. 1) for transferring fluid to the chamber from the container 17F. The fluid transfer means includes a ball check valve (similar to 26 in FIG. 1) which allows fluid being transferred via the fluid transfer means to flow only toward and not away from the chamber.

The dispenser fluid dispenser 11F also includes a hand operated trigger 28F for reciprocatingly moving the piston within the cylinder, alternatingly increasing and decreasing the cylinder head space to draw liquid into the chamber and then expel liquid from the chamber. The dispenser fluid dispenser 11F also includes a circular discharge orifice 30F, together with a cylindrical discharge conduit (similar to 32 in FIG. 1) that provides fluid communication between the chamber and the discharge orifice. The discharge conduit has a discharge check valve (similar to 34 in FIG. 1) that permits fluid to move toward the discharge orifice 30F and not back toward the chamber. The fluid dispenser 11F operates in the same manner as described above with respect to the fluid dispenser 10 of FIG. 1.

Still referring to FIGS. 8-10, the fluid delivery system 10F also includes a second fluid dispenser 70F. The fluid dispenser 70F includes a body 72F that has attachment means for attaching to the body 12F. In one example form, the body 72F may be press fit to the body 12F. The fluid dispenser 70F includes a sprayer mechanism held by or formed within the body 72F. The sprayer mechanism includes a hand operated actuator 74F having a handle 75F and a finger 76F. The handle 75F is pivotally mounted on a pivot pin 77F of the body 72F.

The body 72F has a well 81F that supports an aerosol container 82F, and has an opening 83F through which an end of the aerosol container 82F passes. The body 72F also has a nozzle manifold 85F having a discharge orifice 86F. The body 72F also has a hollow tubular stem socket 88F that is dimensioned in a fashion to receive a valve stem 89F of the aerosol container 82F. The tubular stem socket 88F is connected to the finger 76F. The stem socket 88F exerts pressure on the valve stem 89F when the handle 75F is moved downward in direction D by application of hand or finger pressure on the handle 75F (see FIG. 10). Movement of the valve stem 89F in direction E of FIG. 10 opens a valve 91F and releases the secondary fluid of the aerosol container 82F into the nozzle manifold 85F and through the discharge orifice 86F in a spray S (see FIG. 9).

The fluid delivery system 10F provides a user with a number of fluid delivery options. When a user just wishes to dispense a primary fluid, the trigger 28F is reciprocated to spray the primary fluid from the discharge orifice 30F. When a user wishes to dispense a secondary fluid, the handle 75F is moved downward in direction D by application of hand or finger pressure on the handle 75F and this releases the secondary fluid contents of the aerosol container 82F into the nozzle manifold 85F and through the discharge orifice 86F in a spray S.

The example fluid delivery system 10F uses a propellant and valve 91F as the fluid delivery means for moving the secondary fluid of the aerosol pressurized container 82F into the nozzle manifold 85F and through the discharge orifice 86F. Example propellants include hydrocarbon based propellants, air, nitrogen, and carbon dioxide. However, a pump or pumping mechanism can be used as the fluid delivery means to move the secondary fluid of the container 82F into the nozzle manifold 85F and through the discharge orifice 86F. Example pumps include piston pumps, vein pumps, impeller driven pumps, peristaltic pumps and gear driven pumps.

Figure 11:
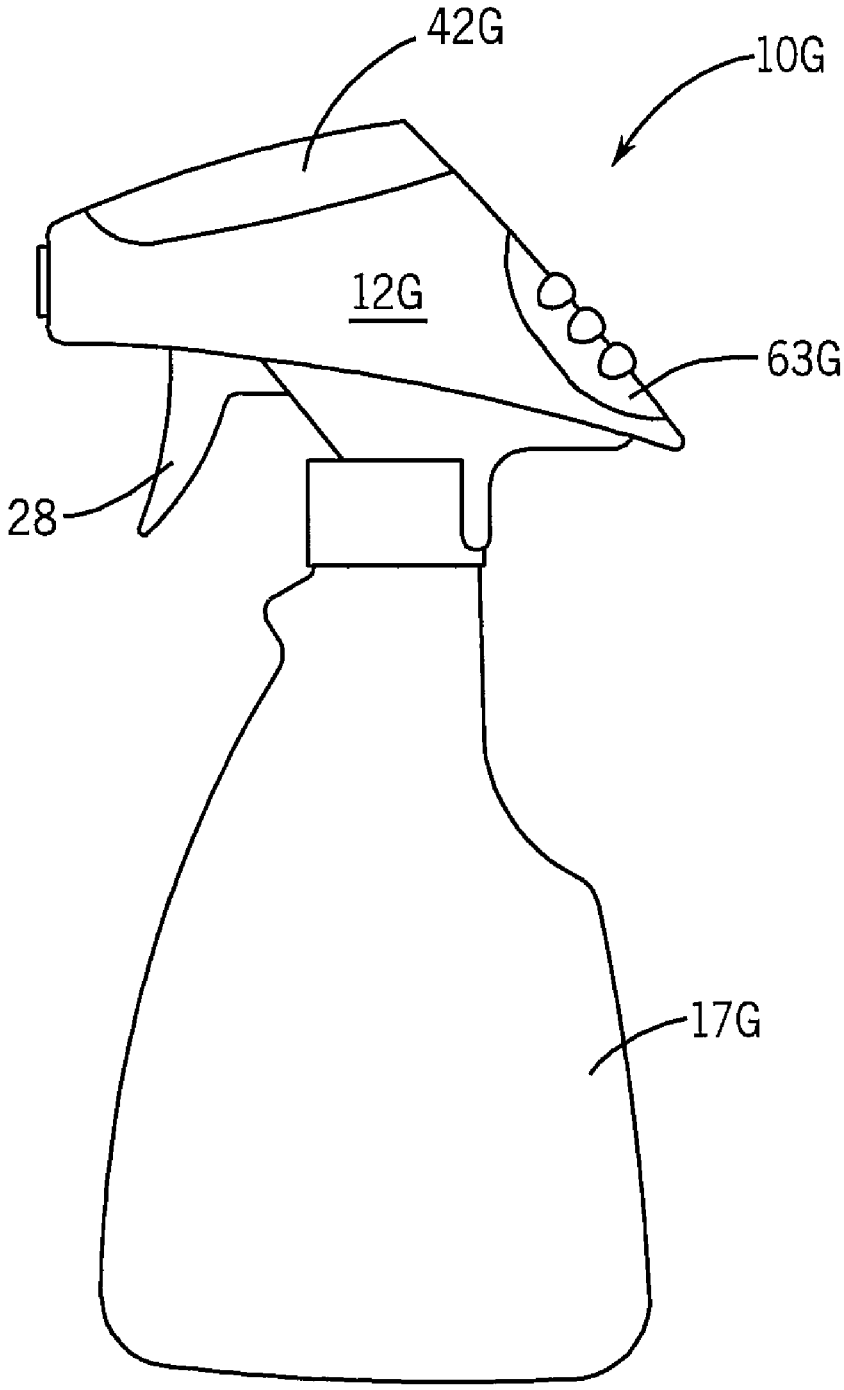
FIG. 11 is a front view of yet another embodiment of a trigger operated fluid delivery system according to the invention mounted on a fluid container.
Figure 12:
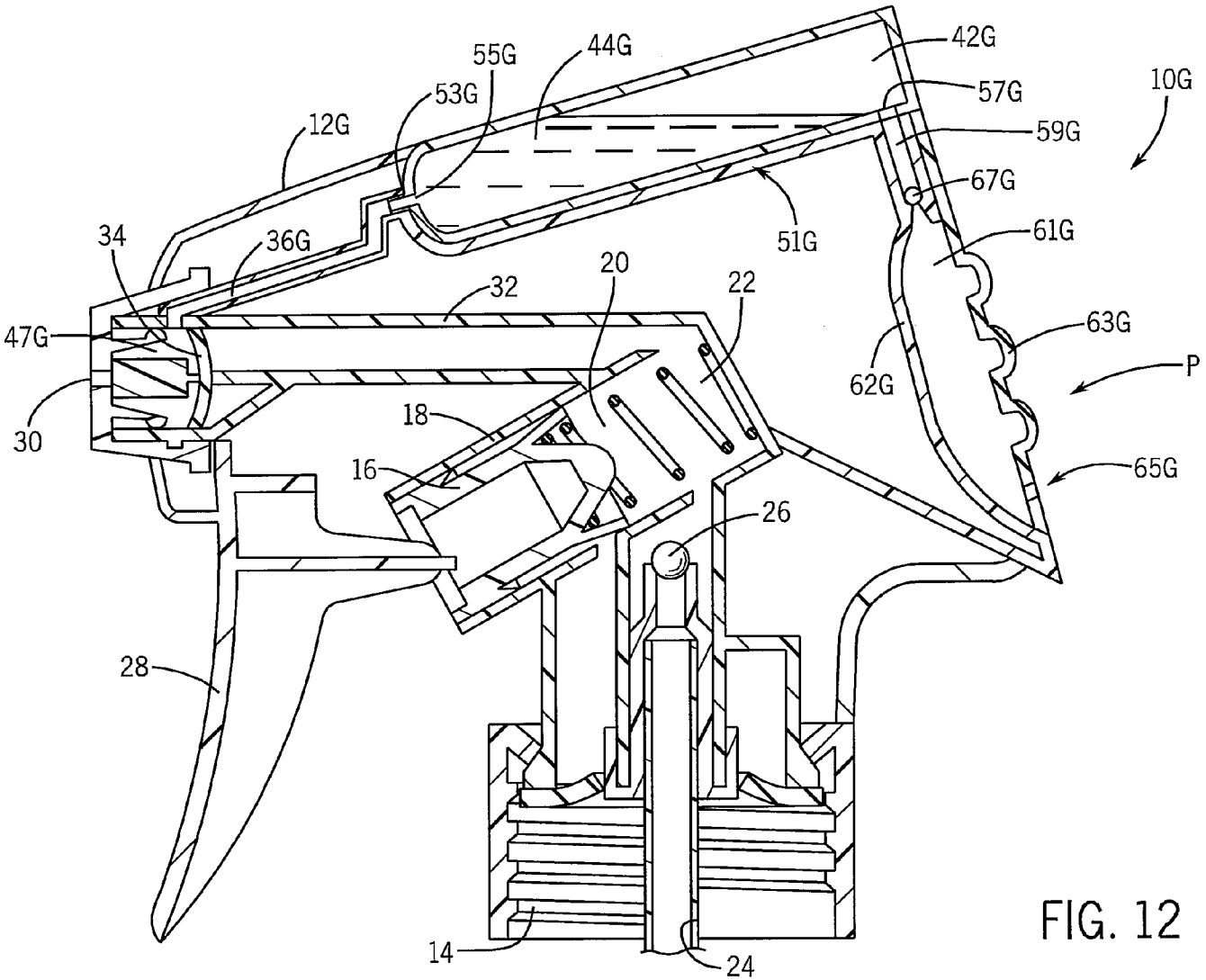
FIG. 12 is a cross-sectional view of the fluid delivery system of FIG. 11.

Turning now to FIGS. 11-12, there is shown another example embodiment of a trigger operated fluid delivery system 10G according to the invention. The fluid delivery system 10G includes attachment means (threads 14), piston 16, primary fluid container 17G, cylinder 18, cylinder head space 20, chamber 22, dip tube 24, check valve 26, trigger 28, discharge orifice 30, cylindrical discharge conduit 32, and discharge check valve 34 that operate as described above with respect to the fluid dispenser 10 of FIG. 1. However, the fluid delivery system 10G includes a body 12G having a second discharge conduit 36G that transfers a secondary fluid 44G from a secondary container 42G to a nozzle manifold 47G.

The body 12G has a well 51G that supports the secondary container 42G, and has an opening 53G through which a port 55G of the secondary container 42G passes. The secondary container 42G has an air inlet 57G that receives air from an air passageway 59G that is in fluid communication with an air space 61G in the body 12G. The air space 61G is defined by an inner wall 62G of the body 12G and by an elastic flexible wall section 63G of the body 12G. An air inlet 65G allows air to pass into the air space 61G. A ball check valve 67G is positioned between the air passageway 59G and the air space 61G to allow air flow in one direction toward the secondary container 42G.

In operation of the fluid delivery system 10G, a user may dispense a primary fluid by reciprocating the trigger 28 to spray the primary fluid from the discharge orifice 30. When a user wishes to dispense a mixture of the primary fluid and a secondary fluid, the user repeatedly pushes the flexible wall section 63G of the body 12G in direction P of FIG. 12. Air is thereby forced into the secondary container 42G by way of the air inlet 57G, the air passageway 59G and the air space 61G in the body 12G. The forced air above the secondary fluid 44G in the secondary container 42G then forces the secondary fluid 44G through the second discharge conduit 36G into the nozzle manifold 47G. Thus, the flexible wall section 63G serves to pump the secondary fluid 44G into the nozzle manifold 47G. When the trigger 28 is thereafter reciprocated, the primary fluid enters the nozzle manifold 47G where the secondary fluid mixes with the stream of primary fluid. The primary fluid/secondary fluid mixture then flows out of the discharge orifice 30.

The embodiments of the invention described above provide for separate dispensing of a primary fluid and a secondary fluid, or provide for dispensing of a mixture of the primary fluid and the secondary fluid. In an example embodiment, the primary fluid is a general purpose or light-duty household cleaner, and the secondary fluid is a concentrate that, when added in small amounts to the primary fluid, yields a new cleaning formulation with consumer-desired properties.

For example, one concept can be called a "booster for kitchen" where a light-duty household cleaner is the primary fluid, and a concentrated formula (the secondary fluid) is added to make an effective grease-cutting formulation.

Another exemplary concept is a "bathroom cleaning booster" where a light-duty household cleaner is combined with an appropriate concentrate (the secondary fluid) to clean soap scum or hard water stains on surfaces. One example benefit of the invention is that it gives the consumer the convenience of a single cleaning product, with the efficacy of two specialty cleaning products. This "booster" concept can be extended to different cleaning categories such as other hard surface cleaners, laundry soil and stain removers, furniture care, and the like. For example, a stronger cleaner can be created by adding a concentrated secondary fluid to a light duty (mostly water, but preferably not all water) primary fluid, or the secondary fluid can be added to the primary fluid to change a light duty glass cleaner into a toilet bowl cleaner. Also, certain unfragranced primary fluids (such as a fluid containing a bleach that would degrade a fragrance) can be fragranced by mixing with a secondary fluid at the time of product use.

The embodiments of the invention are structured so the primary fluid and the secondary fluid in their respective containers do not become contaminated with the other liquid. This has been achieved in a number of ways. For example, the two liquids can only mix on the surface to be treated, that is, the fluid delivery system delivers two spray streams (see FIGS. 8-10) either in a coordinated fashion, or independently sprayed by the user. Alternatively, mixing of the secondary fluid and the primary fluid is confined to one area just before the fluids exit a discharge orifice. In this case, the device can have two discharge conduits (one for mixing, one without mixing—see FIGS. 5-6), or have cross-contamination of the primary fluid and the secondary fluid limited to such a small volume that it has not practical impact on the use application.

Thus, the present invention provides a trigger operated fluid delivery system that allows a user to add a secondary fluid to the spray of a primary fluid.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a fluid delivery system that allows a user to add a secondary fluid to the spray of a primary fluid.

What is claimed is:

1. A fluid delivery system for dispensing two fluids, the fluid delivery system comprising:

a first container having a first fluid;

a body attached to the first container;

a fluid inlet conduit in fluid communication with the first container;

a pump for drawing the first fluid through the fluid inlet conduit and into a pump chamber;

a fluid discharge conduit downstream of the pump chamber, the fluid discharge conduit being in fluid communication with the pump chamber and a discharge orifice, the pump discharging the first fluid from the pump chamber into the fluid discharge conduit;

a second container having a second fluid; and means for delivering the second fluid into the fluid discharge conduit whereby the second fluid mixes with the first fluid when the first fluid is discharged into the fluid discharge conduit such that a mixture of the first fluid and the second fluid is discharged through the discharge orifice, wherein the means for delivering the second fluid into the fluid discharge conduit comprises an aperture in fluid communication with the fluid discharge conduit and a mouth of the second container, and a flow restrictor for selectively sealing off the mouth of the second container, the flow restrictor only restricting flow from the second fluid, wherein the flow restrictor moves between a closed position which seals off the mouth of the second container and an open position in which the second fluid is delivered from the mouth of the second container into the fluid discharge conduit, wherein the flow restrictor is mounted to an outer wall of the body for movement between the closed position and the open position, and wherein the means for delivering the second fluid into the fluid discharge conduit further comprises means for biasing the flow restrictor into the closed position.

2. The fluid delivery system of claim 1 wherein:

the means for delivering the second fluid into the fluid discharge conduit comprises a wicking device in fluid communication with the fluid discharge conduit and a mouth of the second container.

3. The fluid delivery system of claim 2 wherein:

the first fluid contacts the wicking device when the first fluid is discharged into the fluid discharge conduit.

4. The fluid delivery system of claim 1 wherein:

the means for delivering the second fluid into the fluid discharge conduit comprises a second pump for pumping the second fluid into the fluid discharge conduit.

5. The fluid delivery system of claim 4 wherein:

the pump is housed in a body, and the second pump comprises an air space in the body and an elastic wall section of the body, the elastic wall section being located adjacent the air space such that flexing of the elastic wall section forces air into the second container to pump the second fluid into the fluid discharge conduit.

6. The fluid delivery system of claim 5 wherein:

the body has a well for receiving the second container.

7. The fluid delivery system of claim 5 wherein:

the second fluid is delivered into a nozzle manifold.

8. The fluid delivery system of claim 1 wherein:

a distal end of the fluid discharge conduit comprises a nozzle manifold in fluid communication with the discharge orifice, and the second fluid is delivered into the nozzle manifold.

9. The fluid delivery system of claim 1 wherein:

the pump is housed in the body, and the second container is mounted on the outer wall of the body opposite the first container.

10. The fluid delivery system of claim 1 wherein:

the pump is housed in the body, and the second container is mounted in a well in the outer wall of the body.

11. The fluid delivery system of claim 1 wherein:

the pump is housed in the body, and the second container is mounted in an inverted position on the outer wall of the body.

12. The fluid delivery system of claim 1 wherein:

a portion of the flow restrictor extends through the outer body.

* * * * *